United States Patent [19]

Saterdal

[11] 3,935,625

[45] Feb. 3, 1976

[54] METHOD OF MANUFACTURING AXIAL FANS OF DIFFERENT SIZES

[75] Inventor: Edgar Saterdal, Rottne, Sweden

[73] Assignee: Aktiebolaget Svenska Flaktfabriken, Nacka, Sweden

[22] Filed: July 18, 1974

[21] Appl. No.: 489,734

Related U.S. Application Data

[63] Continuation of Ser. No. 238,559, March 27, 1972, now Patent No. 3,844,680.

[30] Foreign Application Priority Data

Mar. 30, 1971 Sweden ..... 4133/71

[52] U.S. Cl. ..... 29/156.8 R; 415/DIG. 3

[51] Int. Cl.[2] ..... B23P 15/00

[58] Field of Search..... 29/156.8 R; 416/157, 137, 416/168, 205, 206; 415/DIG. 3

[56] References Cited

UNITED STATES PATENTS

| | | | |
|---|---|---|---|
| 1,364,755 | 1/1921 | Henington | 416/168 |
| 2,665,054 | 1/1954 | Fischer | 415/129 |
| 2,948,344 | 8/1960 | Biermann | 416/157 |
| 3,231,313 | 1/1966 | Fermer | 416/157 |
| 3,393,748 | 7/1968 | Barnes | 416/157 |
| 3,457,997 | 7/1969 | Mackenzie et al. | 416/205 |
| 3,543,368 | 12/1970 | Marlow | 415/DIG. 3 |
| 3,603,698 | 9/1971 | Jensen | 416/157 |

FOREIGN PATENTS OR APPLICATIONS

| | | | |
|---|---|---|---|
| 700,859 | 12/1953 | United Kingdom | 415/DIG. 3 |
| 880,281 | 10/1961 | United Kingdom | 416/168 |
| 1,011,419 | 12/1965 | United Kingdom | 416/157 |

*Primary Examiner*—C. W. Lanham
*Assistant Examiner*—Dan C. Crane
*Attorney, Agent, or Firm*—Dorfman, Herrell and Skillman

[57] ABSTRACT

A method for manufacturing fan blades which are adjustable in operation. The adjusting means comprises a compressed air box for actuating each fan blade by means of a dog member, said box and said member being non-rotatable on the fan wheel axle. The fan is easy to construct to different demands for capacity due to the fact that fan blade shafts are made in a number of exchangeable preselected standardized sizes and always has the same above mentioned arrangements for the rest of the fan.

3 Claims, 6 Drawing Figures

Figure 1:
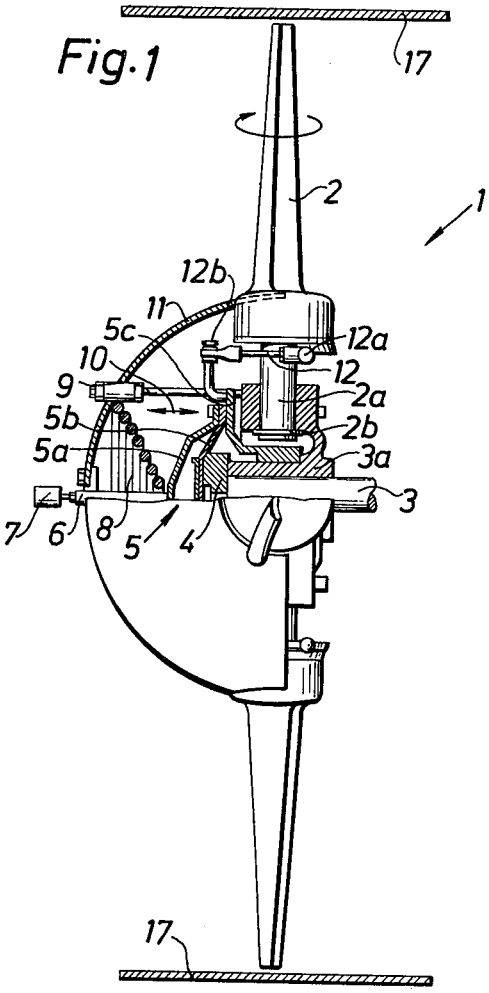

17'
2'
13
I
22'
2b
3a
3

17''
2'
13
II
22''
2b
3a
3

17'''
2'
13
III
22'''
2b
3a
3

METHOD OF MANUFACTURING AXIAL FANS OF DIFFERENT SIZES

This application is a continuation application of Ser. No. 238,559 filed Mar. 27, 1972 now Patent No. 3,844,680.

This invention relates to an axial fan equipped with a plurality of blades adjustable in operation to act upon the adjusting by means of a dog member rotating with the axial fan impeller and simultaneously axially displaceable in relation to said impeller, which dog member is supported on a bearing means separated from the drive shaft of the axial fan impeller, and comprising means for causing each of the fan blades to assume a corresponding setting position responsive to the axial displacement of the dog member, and provided with a preferably semi-spherical impeller casing covering the hub of the axial fan and said dog member and the bearing thereof. The invention further relates to a novel method of manufacturing such an axial fan.

Arrangements for adjusting the fan blades of axial fan impellers in operation are known previously. Their adjusting means usually were designed as a disk inserted into the hub of the fan impeller and having a thickness sufficient to receive in a groove a ball-shaped pin mounted on a radially projecting arm of each fan blade. A combination of worm gears and racks has been utilized for actuating the adjusting means. Adjusting means of the aforesaid kind, however, are heavy, relatively expensive and require much space. Their construction further involves a large gyrating mass, so that for each definite size of rotation of the fan blades large motions of the adjusting means are required and the rotary parts have to meet high requirements with respect to balancing. A further disadvantage of said conventional construction of the adjusting means are the high strains on the bearing means. The present invention has as its object to eliminate the shortcomings of the conventional adjusting means. The novel construction has the advantage of having a light weight, small structural dimensions in the axial direction and a low moment of gyration. The axial fan impeller according to the invention, therefore, can be mounted directly on the axle journal of the drive motor with little adverse effects.

The arrangement according to the invention is characterized in that each fan blade at its end facing the hub portion and said impeller casing is formed to a bearing housing and provided with a blade cover mounted rotatably by said axial bearings on a blade axle secured in the hub of the axial fan impeller, and that each blade cover by means of an arm provided in a point of the circumference of the blade cover and in a point on the outer circumference of the dog member is connected with the dog member for turning the blade cover and thereby the blade through an angle determined by the axial displacement of the dog member, and that the dog member comprises a compressed air box connected to a compressed air line for the supply of compressed air to the interior of said compressed air box for axial displacement of the dog member, preferably against the action of a spring returning the dog member at reduced air pressure.

An expedient embodiment of the arrangement is characterized in that one wall of the compressed air box is a diaphragm of a flexible tight material.

A particularly advantageous embodiment of the arrangement is characterized in that each blade is mounted in a single axial ball bearing disposed in the outer end of the blade axle fixed in the hub of the axial fan impeller, and that the axial pressure required for positioning the fan blade at the standstill of the axial fan impeller, which pressure in operation is produced by the centrifugal force acting on the blade, is produced by a spring, in the form of a spring washer. This embodiment renders possible a compact and particularly space saving construction with very moderate strains on bearing means and balancing arrangements.

The invention comprises a novel and improved method for manufacturing axial fan impellers of different sizes of the aforesaid kind. The method is characterized in that the fan blades are of one and the same size while the blade axles and impeller casings are selected from series of a limited number of standard sizes. This method is highly adapted to render the manufacture of the fan details cheaper and their storage simpler.

The invention is described in greater detail in the following, with reference to the accompanying drawings illustrating an embodiment of the arrangement according to the invention and showing a schematic example of the application of the method for manufacturing axial fan impellers of different sizes of the kind here referred to.

Figure 1A:
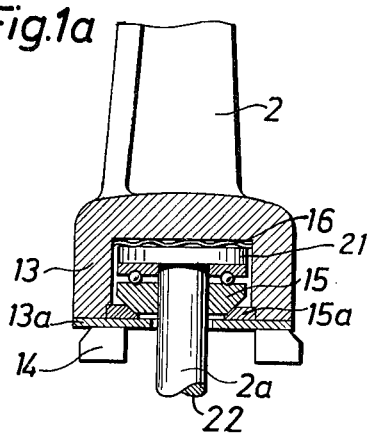
Figure 2:
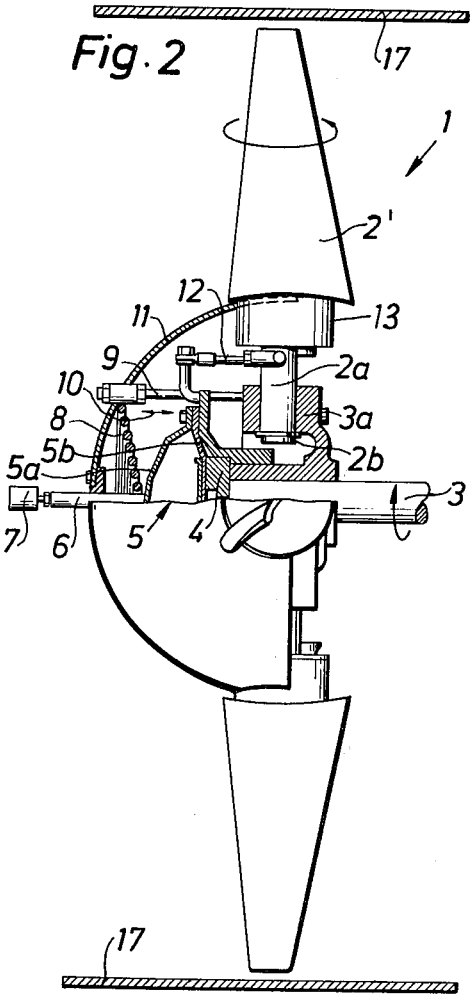

FIG. 1 shows in its upper part a section through the arrangement;

FIG. 1*a* shows on an enlarged scale the special mounting of the fan blade;

FIG. 2 shows the fan blade in a setting position turned through 90°; and

Figures 3A, 3B, 3C:
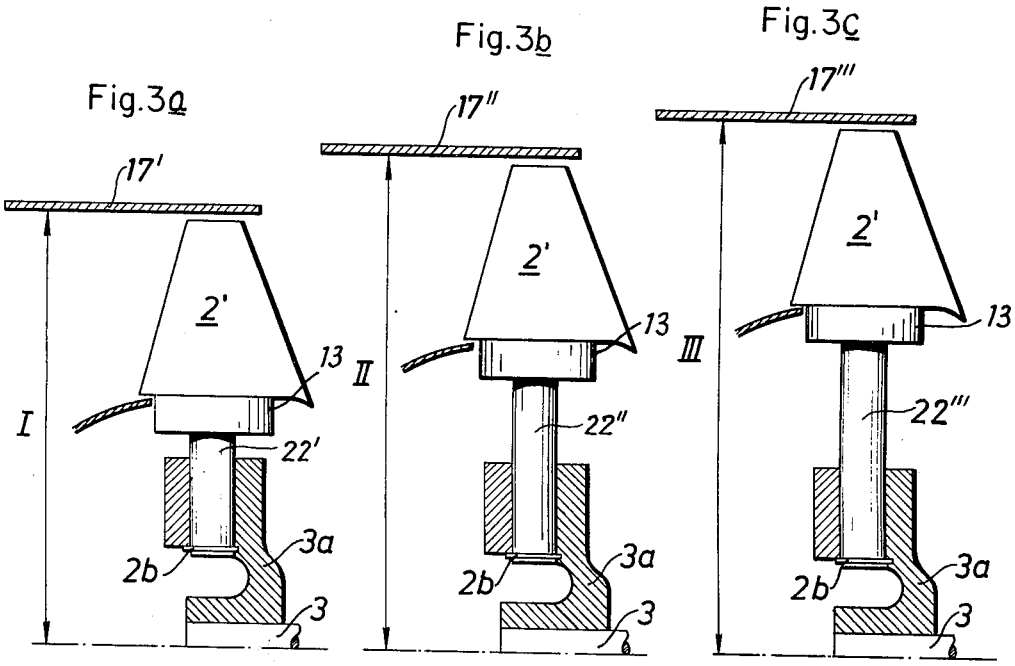

FIGS. 3*a*, 3*b* and 3*c* illustrate a method according to the invention for the manufacture of axial fans of standard elements.

In the FIGS., 1 designates collectively an axial fan intended, for example, to transport fumes from an industrial plant. 2, 2′ designate a fan blade in two different positions with an angular difference of 90° after having been turned about a blade axle **2*a*. 2*b* designates a holding means for each fan blade, the axle of which in the embodiment here referred to is presupposed to be secured on the hub 3*a* and be movable about the outer end of said blade axle 2*a*. The fan blade, therefore, is formed to a bearing housing 13 closed by a blade cover 13*a*, which is provided with a hole for said blade axle 2*a*. The axle 2*a* has an enlarged head 21 in the housing and a stub shaft 22** fixed in the hub.

In said bearing housing 13 is provided an axial bearing 15 with a chamfered limiting surface, which bearing according to the invention is associated with a support ring **15*a*, which also is provided with a chamfered limiting surface. By the novel and improved arrangement according to the invention, owing to its lightweight construction, small structural dimensions in axial direction and low $GD^2$-value, it has proved possible to solve said control and bearing problem by a single axial bearing of the above design. The axial pressure required for positioning the fan blade 2 at the standstill of the axial fan impeller 1, which pressure in operation of the axial fan is produced by the centrifugal force acting on the fan blade, here is produced by a spring washer 16**, the appearance and position of which most clearly is shown in FIG. 1*a*.

4 designates a bearing means for the dog member 5 according to the invention, said member being a compressed air box with walls **5*a*, 5*b* and with a mounting shown at 5*c*. One wall 5*b* of the compressed air box is a diaphragm 5*b* of a flexible tight material, for example plastic or leather. The dog member 5, i.e. the compressed air box, is connected to a compressed air line 6, and 7 designates a connecting fitting for said line. The axial displacement, in the direction of the double arrow 10, is effected against the action of a spring 8, and the motion during the displacement is controlled by a pin 9. Said spring 8 is located between the outer wall 5***a* of the dog member and a housing 11 for the axial fan impeller. 17 designates a conventional cylindric casing around the fan impeller. The arrangement according to the invention for adjusting the fan blades 2 is illustrated in two different setting positions in FIG. 1 and, respectively, FIG. 2. In the first position shown the fan blade is designated by 2, and in the latter position turned through 90° the corresponding fan blade is designated by 2'. FIG. 1*a* shows on an enlarged scale the relative arrangement of the root of the fan blade 2, part of the blade axle 2*a*, the balancing element 14 and the axial bearing 15 with associated supporting ring.

As shown in FIGS. 3*a*, 3*b* and 3*c* the capacity of the fan may be changed by simply exchanging the blade axle 2*a* for an axle having a shaft 22 of a different length, for example as shown at 22', 22'' and 22'''. The cylindrical casing may also be changed as shown at 17', 17'' and 17'''. Thus, by providing axles in sets of standardized lengths, the fan may be assembled to any selected capacity from a number of standardized sizes.

I claim:

1. A method for manufacturing an axial-flow fan having a size selected from a series of a limited number of standard sizes, said fan having a given number of blades which are adjustable as to pitch, the method comprising the steps of supplying a single hub structure having a dog member mounted thereon for axial displacement relative thereto, and means for mounting blades at a given number of connection points around the periphery of the hub; supplying a like number of identical blades adapted to be mounted at said connection points for rotation about a radial axis; supplying means for connecting each of said blades to said dog member to effect rotation of said blades on their axes upon axial displacement of said dog member on the hub axis, providing a limited number of different standard size axles, grouping said axles in one set of axles for each one of said limited number of standard sizes, each set including a number of equal length axles corresponding to said given number of blades, and manufacturing said fan in said selected size by selecting the set of axles corresponding to the desired size and using said set of axles to mount the blades on said hub, by mounting the inner end of each of said axles at one of said connection points and rotatably mounting a blade on the outer end of each of said axles with a single axial-thrust rolling bearing, and positioning said bearing to receive the outward thrust caused by the rotation of the hub structure and centering the bearing by means of a chamfered support ring.

2. A method according to claim 1 including the step of providing a series of casings corresponding to said limited number of standard sizes and including the step in manufacturing said fan of selecting a casing from said series and mounting it concentric with said hub to circumscribe said blades closely adjacent the outer ends thereof.

3. A method according to claim 1 wherein the outer ends of said axles are provided with an enlarged head and including the step of mounting said blades on said axles by positioning an axial rolling bearing around said axle so that one race ring bears against the head of the axle and the other race ring supports the blade, said other race ring having a chamfered surface to mate with said chamfered support ring, and mounting resilient means between said blade and said head to urge said blade outwardly and urge said axial bearing outwardly against said head when said fan impeller is at rest.

* * * * *